US012305481B2

(12) United States Patent
von Gynz-Rekowski et al.

(10) Patent No.: US 12,305,481 B2
(45) Date of Patent: May 20, 2025

(54) SELECTIVELY ACTIVATED FRICTION REDUCTION TOOL AND METHOD

(71) Applicant: Rival Downhole Tools LC, Houston, TX (US)

(72) Inventors: Gunther H H von Gynz-Rekowski, Montgomery, TX (US); Mark Allen Reeves, Houston, TX (US)

(73) Assignee: Rival Downhole Tools LC, Houston, TX (US)

( * ) Notice: Subject to any disclaimer, the term of this patent is extended or adjusted under 35 U.S.C. 154(b) by 0 days.

(21) Appl. No.: 18/331,613

(22) Filed: Jun. 8, 2023

(65) Prior Publication Data

US 2024/0410252 A1 Dec. 12, 2024

(51) Int. Cl.

| | |
|---|---|
| ***E21B 34/14*** | (2006.01) |
| ***E21B 4/02*** | (2006.01) |
| ***E21B 34/06*** | (2006.01) |

(52) U.S. Cl.

CPC ..... *E21B 34/14* (2013.01); *E21B 4/02* (2013.01); *E21B 34/066* (2013.01)

(58) Field of Classification Search

CPC ..... E21B 34/14; E21B 28/00; E21B 34/10; E21B 31/005; E21B 2200/06

See application file for complete search history.

(56) References Cited

U.S. PATENT DOCUMENTS

| | | | |
|---|---|---|---|
| 6,866,104 | B2 | 3/2005 | Stoesz et al. |
| 8,167,051 | B2 | 5/2012 | Eddison et al. |
| 9,273,529 | B2 | 3/2016 | Eddison et al. |
| 9,932,774 | B2 | 4/2018 | Gillis |
| 10,358,872 | B2 | 7/2019 | Rossing et al. |
| 10,487,604 | B2 | 11/2019 | Costa de Oliveira et al. |
| 10,590,709 | B2 | 3/2020 | Sicilian et al. |
| 10,619,437 | B2 | 4/2020 | Lorenson et al. |
| 10,633,920 | B2 | 4/2020 | Lorenson et al. |

(Continued)

FOREIGN PATENT DOCUMENTS

WO WO-2017204947 A1 * 11/2017 ..... E21B 28/00

OTHER PUBLICATIONS

International Search Report and Written Opinion, mailed Jul. 12, 2024, for corresponding International Patent Application No. PCT/US2024/023721.

*Primary Examiner* — Daniel P Stephenson
(74) *Attorney, Agent, or Firm* — Jones Walker LLP

(57) ABSTRACT

A friction reduction tool configured for selective activation downhole in response to a variation in a media flow's operating condition. A valve assembly and an activation assembly are both positioned downstream of a power assembly, which is configured to rotate a rotating valve segment of the valve assembly with media flow through the tool. The activation assembly is configured to transition from a first position to a second position with the media flow operating condition variation. In the first position, the activation assembly provides a bypass flow path around the valve assembly for at least a portion of the media flow, thereby preventing the valve assembly from generating any significant pressure pulse with rotation of the rotating valve segment. In the second position, the bypass flow path is closed such that all or a majority of the media flows through the valve assembly, thereby generating a significant pressure pulse.

22 Claims, 7 Drawing Sheets

(56) References Cited

U.S. PATENT DOCUMENTS

| | | | | |
|---|---|---|---|---|
| 10,648,265 | B2 | 5/2020 | Kinsella et al. | |
| 10,677,006 | B2 | 6/2020 | von Gynz-Rekowski et al. | |
| 10,829,993 | B1 | 11/2020 | von Gynz-Rekowski et al. | |
| 10,968,721 | B2 | 4/2021 | Lorenson et al. | |
| 10,989,004 | B2 | 4/2021 | Russell et al. | |
| 11,002,099 | B2 | 5/2021 | Clausen et al. | |
| 11,091,959 | B2 | 8/2021 | Sicilian et al. | |
| 11,208,846 | B2 | 12/2021 | Rossing et al. | |
| 11,268,337 | B2 | 3/2022 | Kinsella et al. | |
| 2008/0271923 | A1 | 11/2008 | Kusko et al. | |
| 2009/0223676 | A1 | 9/2009 | Eddison et al. | |
| 2011/0073374 | A1 | 3/2011 | Bunney et al. | |
| 2015/0191999 | A1* | 7/2015 | Adam | E21B 23/042 166/66.4 |
| 2017/0016289 | A1 | 1/2017 | Gillis | |
| 2019/0024459 | A1* | 1/2019 | Sicilian | E21B 6/04 |
| 2021/0040808 | A1 | 2/2021 | Russell et al. | |
| 2021/0156212 | A1* | 5/2021 | Damian | F04C 2/1071 |

* cited by examiner

SELECTIVELY ACTIVATED FRICTION REDUCTION TOOL AND METHOD

BACKGROUND OF THE INVENTION

In the drilling of oil and gas wells, a downhole drilling motor and a drill bit are attached to the end of a drill string. Most downhole drilling motors include a rotor rotating within a stator. The rotation of the rotor provides a vibration to the adjacent drill bit as it cuts through the subterranean formation to drill the wellbore. The drill string slides through the higher portions of the wellbore as the drill bit at the end of the drill string extends the wellbore deeper into the formation. A friction reduction tool is sometimes attached to the drill string a distance above the drill bit (e.g., 800-1,500 feet above the drill bit). The friction reduction tool provides vibration to the portions of the drill string above the friction reduction tool, thereby facilitating a smoother movement of the drill string through the wellbore.

However, continuous operation of the friction reduction tool may not be desirable, such as when the drill bit is drilling vertically from the surface. To address such problems, a selectively activated friction reduction tool may be introduced into the drill string to provide vibration to the drill string upon activation of the friction reduction tool. Such a tool is disclosed herein.

DETAILED DESCRIPTION OF THE PREFERRED EMBODIMENTS

A friction reduction tool of the present disclosure is configured to be selectively activated downhole in response to a variation in an operating condition of a media flow through the tool. The friction reduction tool may include a valve assembly positioned downstream of a power assembly. The power assembly may rotate a segment of the valve assembly in response to a flow of a media through tool. In a stationary mode, media flow through the valve assembly may generate no significant pressure pulse or water hammer. In a dynamic mode, media flow through the valve assembly may generate a pressure pulse or water hammer in a media flow column that is transmitted to a coiled tubing line or a shock sub of a drill string to which the friction reduction tool is attached.

In some embodiments, the friction reduction tool may include an activation assembly. When the activation assembly is in a first position, the friction reduction tool operates in the stationary mode. When the activation assembly is in a second position, the friction reduction tool operates in the dynamic mode. The activation assembly may transition from the first position to the second position in response to certain media operating condition adjustments or variations, such as an increased media flow rate or an increased media density. In the first position, the activation assembly may provide a bypass flow path around the valve assembly for at least a portion of the media flowing through the tool. The flow of media through the bypass flow path limits or minimizes the pressure pulse generated by the valve assembly when the activation assembly is in the first position, which places the friction reduction tool in the stationary mode. In the second position, the activation assembly may discontinue, prevent, or minimize the flow of media through the bypass flow path, which results in all or substantially all of the media flowing through the tool to flow through the valve assembly, which generates pressure pulses and places the friction reduction tool in the dynamic mode.

In certain embodiments, the activation assembly includes one or more bypass ports that are open in the first position and substantially closed in the second position. For example, an increase in flow rate or density of the media flowing through the tool may cause a sleeve of the activation assembly to slide from a default position to an engaged position, thereby transitioning the activation assembly from the first position to the second position. In some embodiments, the sleeve of the activation assembly may close the one or more bypass ports in the engaged position. The closing of the one or more bypass ports may transition the friction reduction tool from the stationary mode to the dynamic mode.

Figure 1:
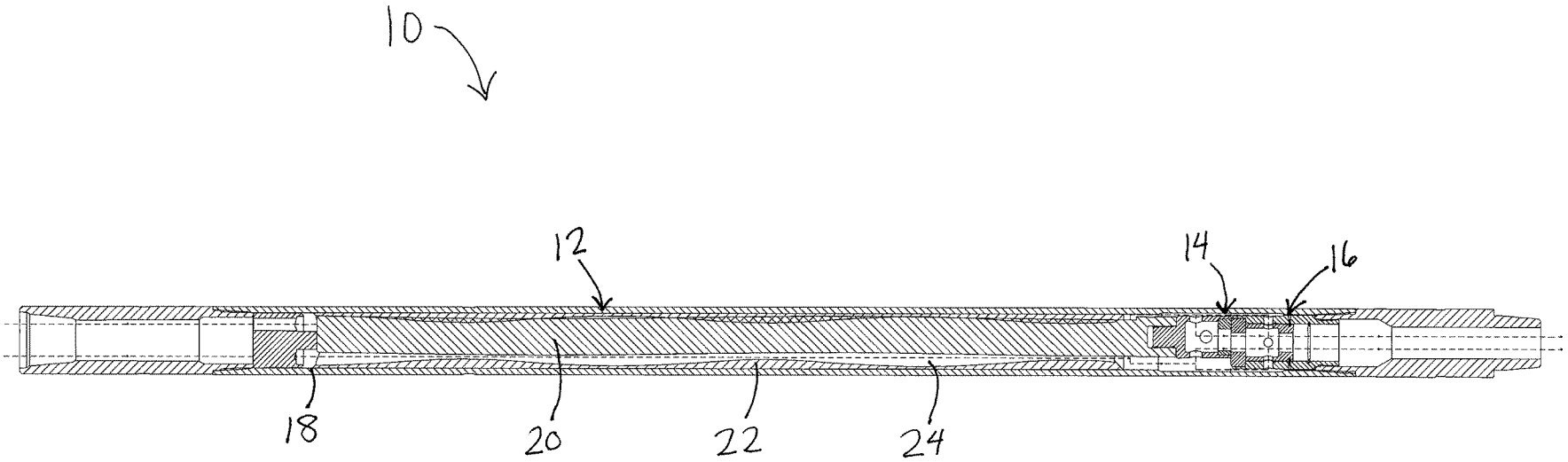
FIG. 1 is a cross-sectional view of one embodiment of a friction reduction tool disclosed herein in a stationary mode.

FIG. 1 illustrates one embodiment of the selectively activated friction reduction tool of the present disclosure. Friction reduction tool 10 may include power assembly 12, valve assembly 14, and activation assembly 16. Friction reduction tool 10 may also include housing 18 having an inner bore, with power assembly 12, valve assembly 14, and activation assembly 16 disposed within the inner bore of housing 18. Housing 18 may be formed of one or more housing segments, each including an inner bore.

Power assembly 12 may include any hydraulic motor, or any other motor driven by a media, which is configured to rotate a rotating valve segment of valve assembly 14. In some embodiments, power assembly 12 may include a positive displacement motor, such as a Moineau motor or any progressive cavity positive displacement pump. In other embodiments, power assembly 12 may include a vane motor. In still other embodiments, power assembly 12 may include a turbine. As used herein, "media" means any liquid or gas, or any mixture, solution, or other combination of one or more liquids and/or one or more gases. Non-limiting examples of media include water-based drilling fluids, oil-based drilling fluids, compressible fluids, mists, nitrogen gas, and underbalanced mixtures of nitrogen gas in liquids.

In the illustrated embodiment, power assembly 12 may include a positive displacement motor having rotor 20 and stator 22. Stator 22 may be secured within the inner bore of housing 18. Rotor 20 may have no axial bore or central bore running therethrough. In one embodiment, rotor 20 may be a single lobe rotor and stator 22 may be a dual lobe stator. Media flowing through the inner bore of housing 18 flows through cavity 24 between rotor 20 and stator 22, which causes rotor 20 to rotate within stator 22. In this way, power assembly 12 includes rotor 20 configured to rotate with the media flow through power assembly 12.

Valve assembly 14 may include a rotating valve segment and a stationary valve segment each including at least one passage. The rotating valve segment may be configured to rotate with rotation of rotor 20, while the stationary valve segment remains fixed (i.e., does not rotate in relation to housing 18). In an open position, the passage of the rotating valve segment is aligned with the passage of the stationary valve segment to allow media flow through these passages. In a restricted position, the passage of the rotating valve segment is not aligned with the passage in the stationary valve segment (e.g., at least partially unaligned), thereby temporarily restricting any media flow through valve assembly 14.

Figure 2:
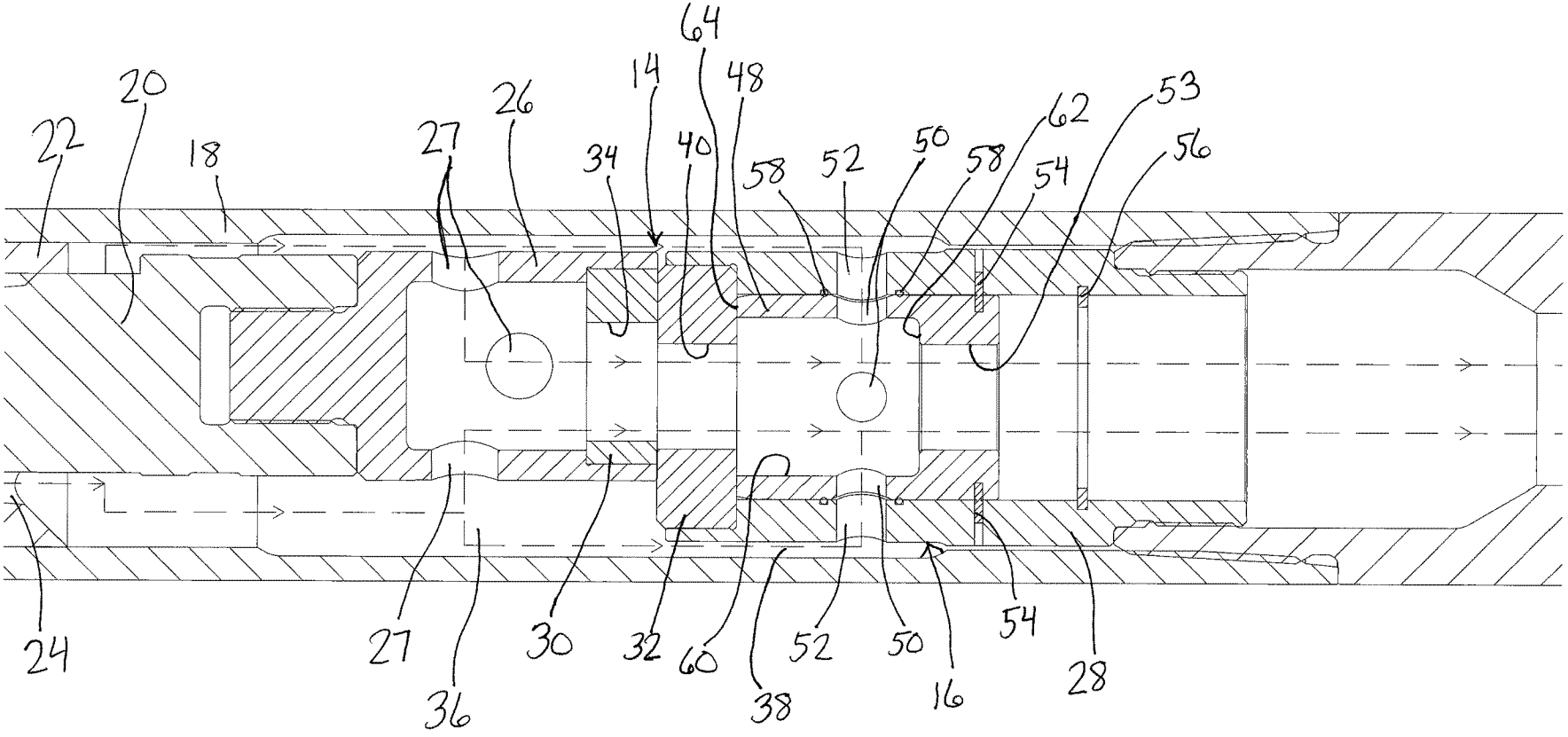
FIG. 2 is a cross-sectional view of an activation assembly of the friction reduction tool in a first position.
Figure 3:
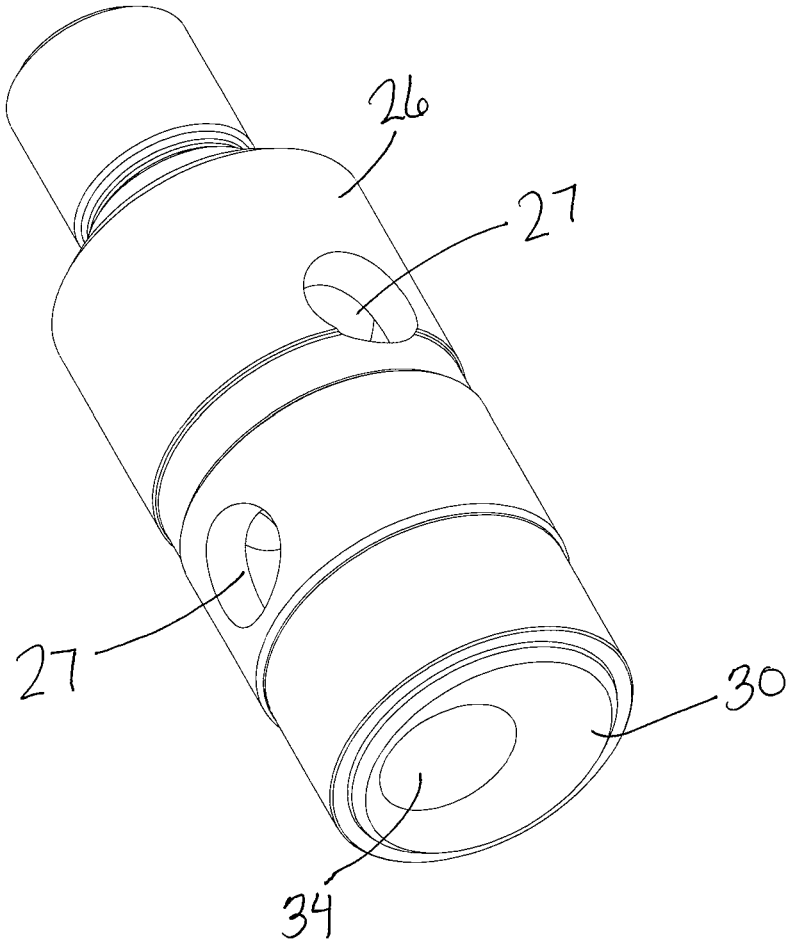
FIG. 3 is a perspective view of a rotating valve segment of the friction reduction tool.
Figure 4:
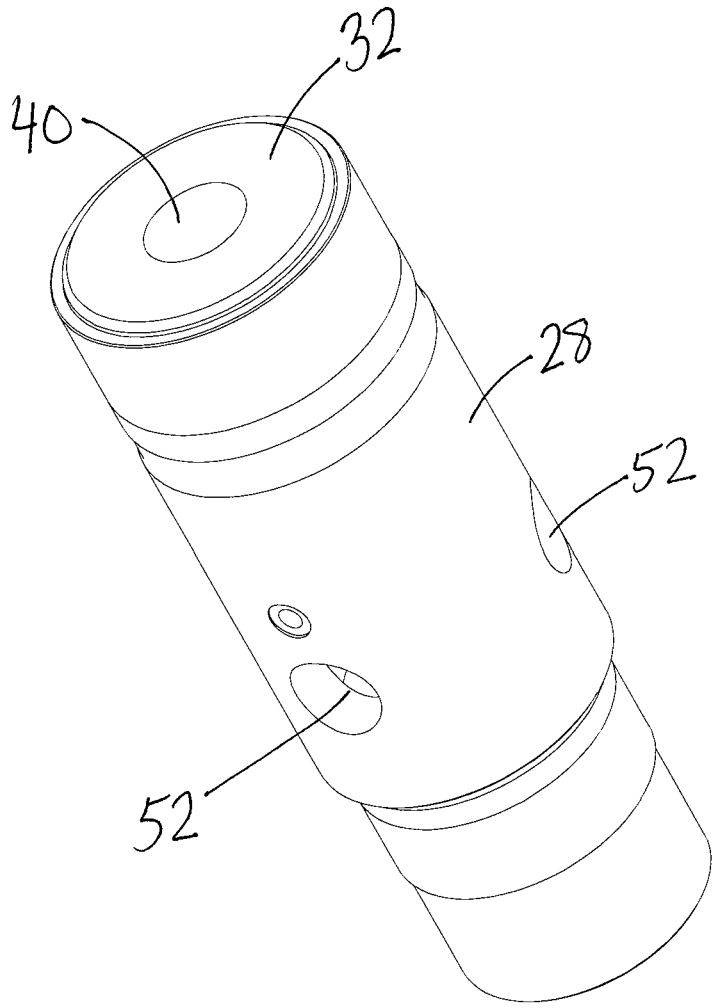
FIG. 4 is a perspective view of a stationary valve segment and activation assembly of the friction reduction tool.

In the embodiment illustrated in FIGS. 2-4, the rotating valve segment of valve assembly 14 may include adaptor 26 and rotating valve disk 30 disposed within an inner bore of adaptor 26. A first end of adaptor 26 may be configured for rotational connection to a portion of power assembly 12 to enable power assembly 12 to rotate adaptor 26 and rotating valve disk 30. For example, the first end of adaptor 26 may be configured for rotational connection to a downstream end of rotor 20 such that rotation of rotor 20 rotates adaptor 26 and rotating valve disk 30. Adaptor 26 may also include one or more ports 27 configured to allow media flow into the inner bore of adaptor 26 from annular space 36 formed between adaptor 26 and housing 18. In some embodiments, lateral ports 27 are distributed around the circumference of adaptor 26 at varying axial positions along the length of adaptor 26 as illustrated in FIGS. 2 and 3. Rotating valve disk 30 may include one or more passages 34 in fluid communication with the inner bore of adaptor 26.

The stationary valve segment may include stationary valve disk 32 that engages rotating valve disk 30. Stationary valve disk 32 may include one or more passages 40. Stationary valve disk 32 may be secured directly or indirectly to housing 18 such that stationary valve disk 32 does not rotate in relation to housing 18. In a non-limiting example shown in the illustrated embodiment, stationary valve disk 32 may be secured at least partially within an inner bore of activation body 28, which is secured to housing 18 such that activation body 28 and stationary valve disk 32 are prevented from rotating relative to housing 18. Numerous alternative embodiments in which tool 10 is configured to prevent rotation of stationary valve disk 32 in relation to housing 18 are readily understood by skilled artisans. In this way, a valve flow path may be defined by annular space 36 surrounding adaptor 26, lateral ports 27 in adaptor 26, the inner bore of adaptor 26, passages 34 of rotating valve disk 30, and passages 40 of stationary valve disk 32. In the illustrated embodiment, rotor 20 is operatively positioned upstream of valve assembly 14 in which the rotating valve segment is positioned upstream of the stationary valve segment. In other embodiments, the rotating valve segment may be positioned downstream of the stationary valve segment.

With reference to FIG. 2, rotation of rotor 20 in the illustrated embodiment causes rotation of adaptor 26 and rotating valve disk 30. Continued flow of media through power assembly 12 causes rotor 20, adaptor 26, and rotating valve disk 30 to continue rotating in the same direction; the direction of rotation of rotating valve disk 30 does not change. Rotating valve disk 30 rotates relative to stationary valve disk 32, which remains fixed and does not rotate relation to housing 18. The relative rotation of rotating valve disk 30 cycles valve assembly 14 between the open position and the restricted position. In the open position, passages 34 of rotating valve disk 30 are aligned with one or more of passages 40 of stationary valve disk 32. In the restricted position, passages 34 of rotating valve disk 30 are at least non-aligned with one or more of passages 40 of stationary valve disk 32. In other words, the valve flow path is open in the open position of the valve assembly 14 and closed in the closed position of valve assembly 14.

FIGS. 1 and 2 illustrate one embodiment of a first position of activation assembly 16. In this first position, activation assembly 16 provides a bypass flow path around valve assembly 14 for a portion of a media flowing through friction reduction tool 10. The remainder of the media may flow through valve assembly 14 while activation assembly 16 is in the first position, which places friction reduction tool 10 in the stationary mode. In this way, activation assembly 16 may provide a partial bypass around valve assembly 14 when in the first position. The bypass flow path may have a greater cross-sectional area than the valve flow path. In some embodiments, a majority of the media flowing through friction reduction tool 10 may bypass valve assembly 14 while tool 10 is in the stationary mode due to the bypass flow path's greater cross-sectional area. In other embodiments, all of the media flowing through friction reduction tool 10 in the stationary mode may bypass valve assembly 14. In this way, activation assembly 16 may provide a complete bypass when in the first position. As used herein in reference to the bypass flow path, the bypass flow, and/or the bypass, "around" the valve assembly means any flow path that allows fluid to flow downstream beyond the position of the valve assembly within the friction reduction tool without flowing through the valve assembly, including outside of the valve assembly, past the valve assembly, and/or through a separate component that is near the valve assembly.

With reference to FIGS. 2 and 4, the illustrated embodiment of activation assembly 16 may include activation sleeve 48 disposed within an inner bore of activation body 28. Activation sleeve 48 and activation body 28 may each include one or more lateral bypass ports 50 and 52, respectively. The bypass flow path may be defined by annular space 38 between activation body 28 and housing 18, bypass ports 52 of activation body 28, and bypass ports 50 of activation sleeve 48. This bypass flow path may have a greater cross-sectional area than the valve flow path in this embodiment. In other embodiments, the bypass flow path may include any other flow path around valve assembly 14, with or without any bypass ports. For example, the bypass flow path may include an annular space between two components of the activation assembly 16 without any bypass ports. Activation sleeve 48 may further include restricted inner bore section 53 forming shoulder 62 within the inner bore of activation sleeve 48. Both restricted inner bore section 53 and shoulder 62 may be positioned downstream of bypass ports 50. Restricted inner bore section 53 may provide the minimum cross-sectional flow area within friction reduction tool 10. All media flowing through the valve flow path and all media flowing through the bypass flow path are directed to and must flow through restricted inner bore section 53 of activation sleeve 48. In this way, restricted inner bore section 53 may provide a nozzle through which all media flowing through friction reduction tool 10 must flow.

Activation assembly 16 may further include one or more shear mechanisms 54, one or more stop mechanisms 56, and one or more seals 58. Each shear mechanism 54 may extend from a lateral bore or recess in activation body 28 into a lateral bore or recess in activation sleeve 48. With activation assembly 16 in the first position, the shear mechanisms 54 may be disposed upstream, downstream, or at least one upstream and at least one downstream of the bypass ports in activation sleeve 48 and/or the bypass ports in activation body 28. The shear mechanisms 54 may include shear pins, set screws, O-rings, spring-loaded ball arrangements, or any other mechanisms configured to break or change positions in response to a predefined downstream force in order to allow activation sleeve 48 to slide relative to activation body 28. Each stop mechanism 56 may extend from a lateral bore or recess in the inner bore of activation body 28. The stop mechanism 56 may include a ring, an upset, one or more set screws, or any other mechanism configured to limit downstream movement of activation sleeve 48 relative to activation body 28. The seals 58 may include O-rings or any other seal elements.

Referring again to FIG. 2, when activation assembly 16 is in the first position, activation sleeve 48 may be positioned within the inner bore of activation body 28 such that bypass ports 50 of activation sleeve 48 are aligned with bypass ports 52 of activation body 28. In the first position, at least a portion of the media flowing through friction reduction tool 10 may travel from cavity 24 between stator 22 and rotor 20, through annular space 36 between adaptor 26 and housing 18, through the bypass flow path described above, and into restricted inner bore section 53 of activation sleeve 48. In some embodiments, a majority of the media flowing through friction reduction tool 10 may flow through the bypass flow path while activation assembly 16 is in the first position. In other embodiments, all of the media flowing through friction reduction tool 10 may flow through the bypass flow path while activation assembly 16 is in the first stationary position. Seals 58 may prevent or minimize leakage between bypass ports 50 of activation sleeve 48 and bypass ports 52 of activation body 28.

Activation assembly 16 may be operatively positioned downstream of rotor 20. In certain embodiments, activation assembly 16 may be operatively positioned downstream of valve assembly 14. In the illustrated embodiment, activation assembly 16 may be operatively positioned downstream of both rotor 20 and valve assembly 14.

With reference to FIGS. 1 and 2, a media flowing into housing 18 of friction reduction tool 10 may flow into cavity 24 between stator 22 and rotor 20. The media flow through cavity 24 rotates rotor 20, thereby cycling valve assembly 14 between the open position and the closed position by rotating adaptor 26 and rotating valve disk 30 in relation to stationary valve disk 32. Media exiting cavity 24 may flow into annular space 36 surrounding adaptor 26. With activation sleeve 48 in the first position, all or a portion of the media in annular space 36 may flow through the bypass flow path, which includes annular space 38 surrounding activation body 28, bypass ports 52 of activation body 28, and bypass ports 50 of activation sleeve 48, and may continue flowing through the restricted inner bore section 53 of activation sleeve 48. In this way, at least a portion of the media flowing through tool 10 bypasses around the valve flow path of valve assembly 14, which includes lateral ports 27 of adaptor 26, the inner bore of adaptor 26, passages 34 of rotating valve disk 30, and passages 40 of stationary valve disk 32. To the extent that any media flows from annular space 36 into the valve flow path, the continued media flow through open bypass flow path provided by activation assembly 16 in the first position minimizes or completely prevents any pressure pulse or water hammer associated with an interruption of the media flow in the valve flow path when the valve assembly 14 cycles between the open and closed positions. In this way, the bypass flow path provided by activation assembly 16 prevents friction reduction tool 10 from generating any pressure pulses, or minimizes any pressure pulses generated, when media flows through the tool 10 in the stationary mode. In other words, the bypass flow path limits any pressure pulses generated by friction reduction tool 10 in the stationary position to only insignificant pressure pulses. As used herein, an "insignificant" pressure pulse is a pressure pulse of a magnitude that does not cause stretching or retracting of a coiled tubing string, or activation of axial movement of a shock sub or any other part of a drill string, to which friction reduction tool 10 is connected. For example, but not by way of limitation, insignificant pressure pulses generated by friction reduction tool 10 in the stationary mode may be limited to less than 200 psi, or less than 100 psi.

Figure 5:
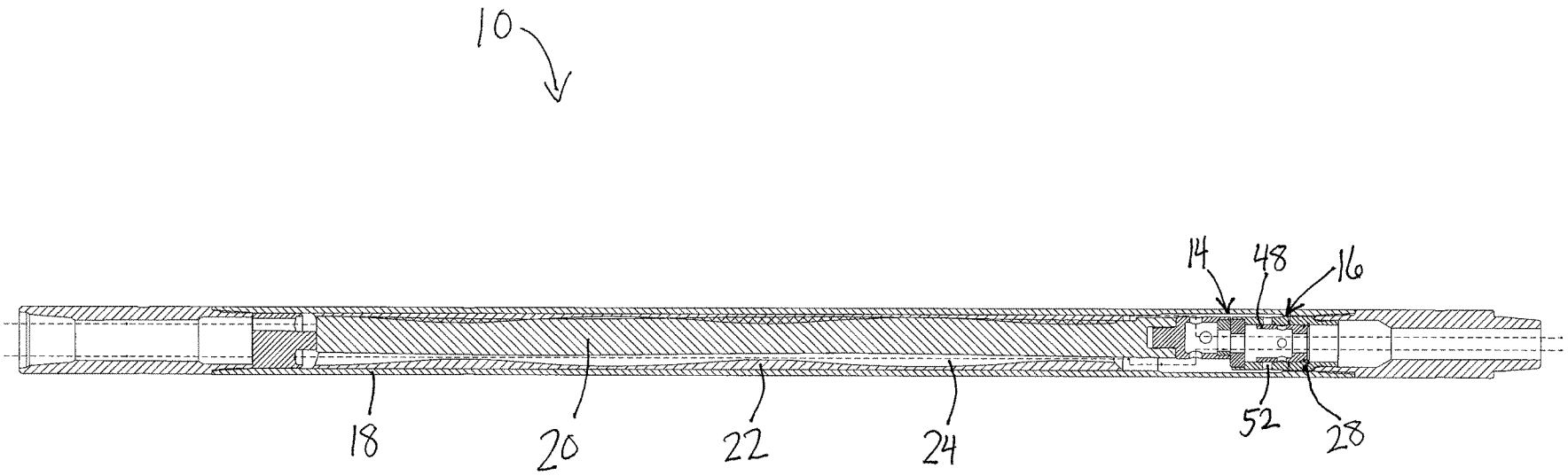
FIG. 5 is a cross-sectional view of the friction reduction tool in a dynamic mode.
Figure 6:
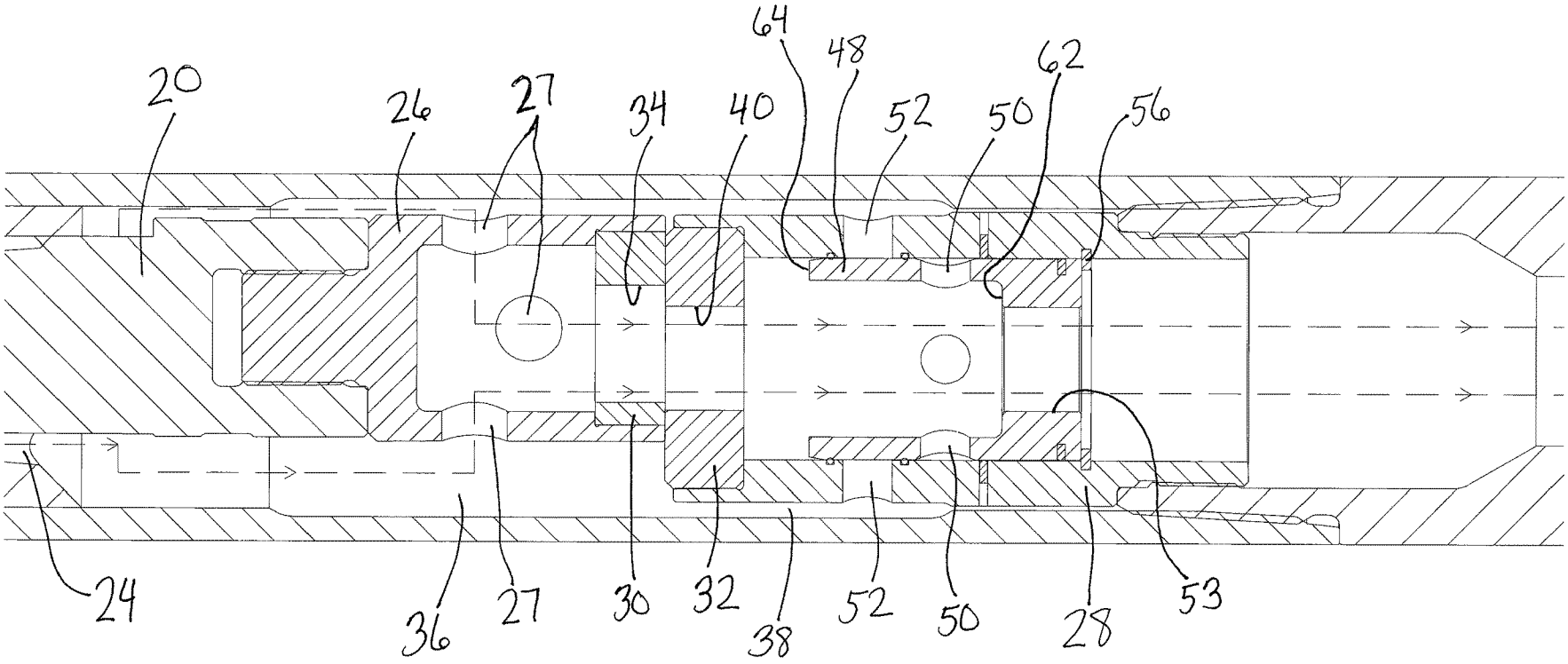
FIG. 6 is a cross-sectional view of the activation assembly in a second position.

Activation assembly 16 may be configured to selectively activate friction reduction tool 10 by transitioning friction reduction tool 10 from the stationary mode shown in FIGS. 1 and 2 into the dynamic mode shown in FIGS. 5 and 6. The selective activation may be effected by transitioning activation assembly 16 from the first position, which is its default position, into a second position. In some embodiments, activation may be reversed by transitioning activation assembly 16 from the second position into the first position. In other embodiments, activation may not be reversible.

With reference to FIGS. 2 and 6, the differential pressure created by media flow through the inner bore 60 of activation sleeve 48, including through restricted inner bore section 53, may place a downstream force on shoulder 62 and shoulder 64 of activation sleeve 48. Shear mechanisms 54 may be configured to retain activation sleeve 48 in the first position shown in FIG. 2 until a predetermined maximum downstream force is placed on shoulders 62 and 64. Shear mechanisms 54 may be configured to break when the differential pressure imposes a downstream force on shoulders 62 and 64 of activation sleeve 48 exceeding such maximum downstream force. After shear mechanisms 54 break, activation sleeve 48 is permitted to slide within the inner bore of activation body 28. In the illustrated embodiment, restricted inner bore section 53 and shoulder 62 are integrally formed with the inner bore 60 of activation sleeve 48. In other embodiments, the restricted inner bore section 53 and shoulder 62 may be provided by a separate component secured to activation sleeve 48 via a connection of sufficient strength to maintain the connection between the separate component and activation sleeve 48 when the downstream force acting on shoulder 62 exceeds the maximum predetermined downstream force that causes shear mechanisms 54 to break, such that the separate component slides with activation sleeve 48 within activation body 28.

To selectively activate the friction reduction tool 10, a user may vary an operating condition of the media flowing through friction reduction tool 10 in order to increase the downstream force on shoulders 62 and 64 of activation sleeve 48 above the predetermined maximum downstream force associated with shear mechanisms 54. For example, the downstream force on shoulders 62 and 64 and the differential pressure across activation assembly 16 may be increased by increasing the flow rate of the media, by increasing the media's density, or by increasing both the flow rate of the media and the media's density. Each of these operating condition changes cause an increased downstream force to be applied to shoulders 62 and 64. Once friction reduction tool 10 is activated by breaking shear mechanisms 54, the continued flow of media through tool 10 may apply a continued downstream force on shoulder 62, which slides activation sleeve 48 in a downstream direction within the inner bore of activation body 28 until activation sleeve 48 engages stop mechanism 56 in a second position shown in FIG. 6.

FIGS. 5 and 6 illustrate activation assembly 16 in the second position after activation. Transitioning activation assembly 16 into the second position places friction reduction tool 10 in a dynamic mode. In this second position, activation sleeve 48 is positioned within the inner bore of activation body 28 such that bypass ports 50 of activation sleeve 48 are not aligned with bypass ports 52 of activation body 28. For example, activation sleeve 48 may block bypass ports 52 of activation body 28. In this way, the bypass flow path may be substantially closed or blocked in the second position of the activation assembly 16. In this position, seals 58 may prevent or minimize leakage between activation sleeve 48 and bypass ports 52 of activation body 28. In some embodiments, minimal leakage may be possible through the bypass flow path without affecting the function of friction reduction tool 10. Stop mechanism 56 may prevent further downhole axial movement of activation sleeve 48 past the second position in which activation sleeve 48 closes the bypass flow path.

Because the bypass flow path is substantially closed or blocked when activation sleeve 48 is in the second position, all or a majority of the media flowing from cavity 24 into annular space 36 may flow through the valve flow path of valve assembly 14. In this position, rotation of rotor 20 in response to media flowing through cavity 24 causes valve assembly 14 to cycle between the open position and the closed position. In the open position, the media is allowed to flow through the valve flow path of the valve assembly 14. However, in the closed position, the unaligned passages 34 and 40 of rotating valve disk 30 and stationary valve disk 32, respectively, temporarily restricts or limits media flow through the valve flow path. As media flows through the valve flow path of valve assembly 14 with activation assembly 16 in the second position, the cycling between the open position and the closed position of valve assembly 14 generates a significant repeated pressure pulse or water hammer in a media flow column (i.e., the column of media formed within friction reduction tool 10 and the drill string or coiled tubing line to which it is attached). In this way, friction reduction tool 10 generates significant pressure pulses when media flows through the tool 10 in the dynamic mode after activation of activation assembly 16. As used herein, "significant" pressure pulses or water hammer are pressure pulses or water hammer of sufficient magnitude to stretch or retract a coiled tubing string, or to activate axial movement of a shock sub or another part of a drill string, to which friction reduction tool 10 is connected. For example, but not by way of limitation, significant pressure pulses may be greater than 200 psi, or greater than 300 psi. Whether a pressure pulse of a certain magnitude is significant may depend on the design and configuration of the specific embodiment of the friction reduction tool and the surrounding portions of a coiled tubing string or drill string, such as a shock sub.

In certain alternate embodiments, the activation sleeve of activation assembly 16 may be disposed around the outer surface of the activation body, with the activation sleeve transitioning from a first position, in which it leaves open the one or more bypass ports of the activation body, to a second position, in which it closes the one or more bypass ports in the activation body.

Accordingly, with activation assembly 16 in either the first position or the second position (i.e., in either the stationary mode or dynamic mode of friction reduction tool 10), media flow through cavity 24 rotates rotor 20 and the rotating valve segment of valve assembly 14. However, the bypass flow path provided by activation assembly 16 in the first position minimizes the amount of, or eliminates, media flow through the valve flow path of valve assembly 14 such that the cycling of valve assembly 14 between the open position and the closed position does not generate any significant pressure pulse in the stationary mode of friction reduction tool 10. The activation of friction reduction tool 10 into the dynamic mode with the transition of activation assembly 16 into the second position completely closes, or at least substantially closes, the bypass flow path such that all, or substantially all, of the media flows through the valve flow path of valve assembly 14, thereby generating significant pressure pulses with the cycling of valve assembly 14 between the open position and the closed position.

Figure 7:
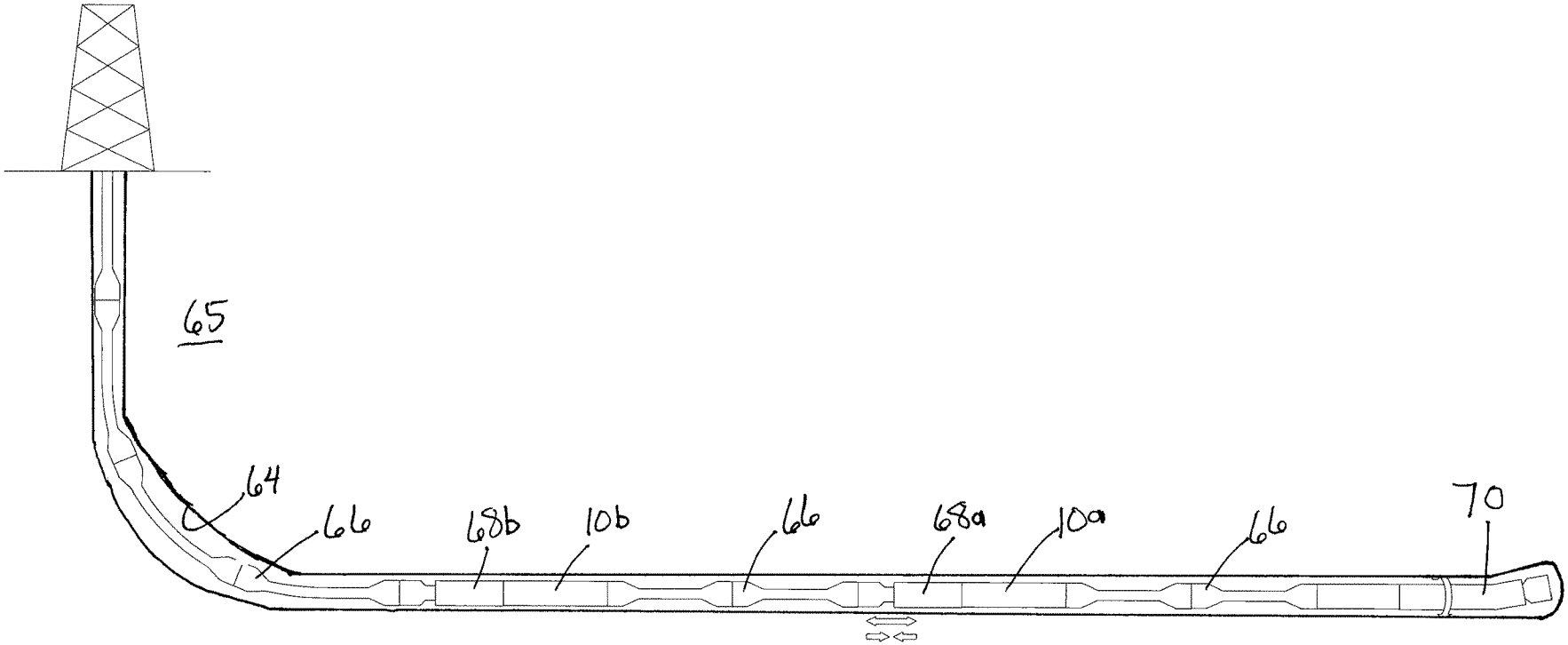
FIG. 7 is a cross-sectional view of the friction reduction tool disposed within a wellbore.

Referring now to FIG. 7, friction reduction tool 10*a* may be placed into wellbore 64 extending into subterranean formation 65. Friction reduction tool 10*a* may be secured to drill string 66 by threadedly connecting friction reduction tool 10*a* to shock assembly 68*a* and drill string 66. Friction reduction tool 10*a* may be in the stationary mode when initially deployed. In the stationary mode, at least a portion of a media flowing through friction reduction tool 10*a* will flow through the bypass flow path provided by activation assembly 16 of friction reduction tool 10*a* in its first position. Accordingly, at least a portion of the media flowing through drill string 66 will bypass valve assembly 14 of friction reduction tool 10*a*, thereby allowing only insignificant pressure pulses to be created by the cycling of the valve assembly 14 between the open position and the closed position. In some embodiments, a portion of the media flowing through friction reduction tool 10*a* in the stationary mode may flow through valve assembly 14 cycling between the open position and the closed position without generating any significant pressure pulse, i.e., without generating any pressure pulse sufficient to activate adjacent shock assembly 68*a*.

Friction reduction tool 10*a* may be selectively activated from the stationary mode to the dynamic mode by increasing the differential pressure across shoulders 62 and 64 of activation sleeve 48 within friction reduction tool 10*a*. This selective activation may be accomplished by increasing a flow rate, increasing a density, or increasing both a flow rate and a density of the media flowing through the drill string 66. For example, a user may increase media density by introducing a higher density media in a pill into the drill string 66 for a certain period of time. The increased media flow rate or increased media density, or both, may increase the pressure drop across activation sleeve 48 and apply an increased downstream force on shoulders 62 and 64 of activation sleeve 48 within friction reduction tool 10*a*. The pressure drop increase and downstream force increase created by a particular media condition adjustment is determined by the cross-sectional area of the nozzle provided by the inner bore of the tool's activation sleeve 48 upstream of shoulder 62 and by the reduced inner bore section 53 of the tool's activation sleeve 48 downstream of shoulder 62. When the increased downstream force exceeds a predefined maximum limit, shear mechanisms 54 within friction reduction tool 10*a* may break, thereby allowing activation sleeve 48 to move downstream into the second position in which the bypass flow path is blocked or closed. In this way, friction reduction tool 10*a* may be selectively activated from the stationary mode into the dynamic mode. Once the friction reduction tool 10*a* is activated and placed in the dynamic mode, all or a majority of the media flowing through friction reduction tool 10*a* will flow through valve assembly 14, thereby generating a significant pressure pulse or water hammer as valve assembly 14 cycles between the open position and closed position. The generated significant pressure pulse or water hammer may be transmitted to drill string 66 (or a coiled tubing string) to which friction reduction tool 10*a* is connected. The repeated significant pressure pulse generation may cause axial movement of a portion of shock assembly 68*a* (or stretching and retracting in a coiled tubing string to which friction reduction tool 10*a* is connected), thereby facilitating axial vibration and easing the movement of the drill string through wellbore 64. The vibration may reduce friction between an outer surface of the drill string and an inner surface of wellbore 64.

In certain embodiments, shock assembly 68*a* may be connected to an upstream end of friction reduction tool 10*a*. When present, the shock assembly 68*a* may facilitate relative axial movement of drill string 66 above friction reduction tool 10*a* relative to drill string 66 downstream of friction reduction tool 10*a* thereby vibrating drill string 66 above friction reduction tool 10*a*.

In certain embodiments, only friction reduction tool 10*a* may be deployed within wellbore 64. In other embodiments, two or more friction reduction tools, such as friction reduction tool 10*a* and friction reduction tool 10*b*, may be deployed within wellbore 64 as shown in FIG. 7. In some embodiments, both friction reduction tools 10*a* and 10*b* may be activated from the stationary mode to the dynamic mode with a single adjustment to the media operating condition. This concurrent activation of both friction reduction tools 10*a* and 10*b* may be accomplished when the nozzle provided by the reduced inner bore section 53 of each tool's activation sleeve 48 have the same cross-sectional area.

Alternatively, each of friction reduction tools 10*a* and 10*b* may be configured to be activated by a different value of a media operating condition adjustment by designing the nozzle provided by the restricted inner bore section 53 of each tool's activation sleeve 48 to have a different cross-sectional area. For example, downstream friction reduction tool 10*a* may be configured to be activated before upstream friction reduction tool 10*b*. In this embodiment, a smaller increase in media flow rate and/or media density will activate friction reduction tool 10*a*, while a larger increase in media flow rate and/or media density will be required to activate friction reduction tool 10*b*. This configuration may be achieved by sizing the nozzle provided by restricted inner bore section 53 of friction reduction tool 10*a*'s activation sleeve 48 to be smaller than the nozzle provided by restricted inner bore section 53 of friction reduction tool 10*b*'s activation sleeve 48. In another example, upstream friction reduction tool 10*b* may be configured to be activated before downstream friction reduction tool 10*a*. In this embodiment, a smaller increase in media flow rate and/or media density will activate friction reduction tool 10*b*, while a larger increase in media flow rate and/or media density will be required to activate friction reduction tool 10*a*. This configuration may be achieved by sizing the nozzle provided within friction reduction tool 10*b*'s activation sleeve 48 to be smaller than the nozzle provided within friction reduction tool 10*a*'s activation sleeve 48. Accordingly, two or more friction reduction tools 10 may be configured to be activated in any order within a drill string or coiled tubing string regardless of each friction reduction tool's position.

In some embodiments, downstream friction reduction tool 10*a* may be introduced into the wellbore in the dynamic mode while one or more upstream friction reduction tools 10*b* are introduced into the wellbore in the stationary mode, such that these upstream friction reduction tools 10*b* may be activated with a single or multiple media operating condition adjustments while disposed in the wellbore. Alternatively, a conventional friction reduction tool that operates only in a dynamic mode to generate significant pressure pulses with media flow therethrough may be placed in the drill string 66 between downhole selectively activated friction reduction tool 10*a* and the bottom hole assembly 70.

As used herein, "above" and any other indication of a greater height or latitude shall also mean upstream, and "below" and any other indication of a lesser height or latitude shall also mean downstream. As used herein, "downhole string" shall include a series of drill string or pipe segments and a coiled tubing line, along with any components secured thereto, including without limitation shock assemblies or shock subs.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A downhole friction reduction tool, comprising:

a power assembly;

a valve assembly operatively connected downstream of the power assembly, the valve assembly including a rotating valve segment and a stationary valve segment; and an activation assembly operatively connected downstream of the power assembly, wherein in a first position the activation assembly provides a bypass flow path around the valve assembly for at least a portion of a media flow through the power assembly, wherein the activation assembly is configured to transition from the first position to a second position in response to a variation in an operating condition of the media flow, wherein in the second position of the activation assembly the bypass flow path is substantially closed;

wherein the power assembly is configured to rotate the rotating valve segment in relation to the stationary valve segment upon the media flow through the power assembly, wherein the valve assembly is configured to generate significant pressure pulses in a media flow column with the rotation of the rotating valve segment only when the activation assembly is in the second position;

wherein the variation in the operating condition of the media flow is an increase in a flow rate of the media flow, or is an increase in a density of a media in the media flow, or is both an increase in the flow rate of the media flow and an increase in the density of the media in the media flow.

2. The downhole friction reduction tool of claim 1, wherein the power assembly includes a Moineau motor having a single lobe rotor and a dual lobe stator.

3. The downhole friction reduction tool of claim 1, wherein the power assembly is configured to rotate the rotating valve segment when the activation assembly is in the first position and in the second position.

4. The downhole friction reduction tool of claim 1, wherein less than all of the media flow through the power assembly flows through the bypass flow path and a remainder of the media flow flows through the valve assembly when the activation assembly is in the first position; wherein substantially all of the media flow through the power assembly flows through the valve assembly when the activation assembly is in the second position.

5. The downhole friction reduction tool of claim 1, wherein all of the media flow through the power assembly flows through the bypass flow path when the activation assembly is in the first position; wherein substantially all of the media flow through the power assembly flows through the valve assembly when the activation assembly is in the second position.

6. The downhole friction reduction tool of claim 1, wherein the bypass flow path includes one or more bypass ports that are open in the first position of the activation assembly and closed in the second position of the activation assembly.

7. The downhole friction reduction tool of claim 6, wherein the activation assembly includes a sleeve, wherein the sleeve closes the one or more bypass ports in the second position of the activation assembly.

8. The downhole friction reduction tool of claim 7, wherein the sleeve includes one or more bypass openings that are aligned with the one or more bypass ports in the first position of the activation assembly and unaligned with the one or more bypass ports in the second position of the activation assembly.

9. A downhole friction reduction tool, comprising:

a power assembly including a positive displacement motor having a rotor and a stator, wherein the rotor contains no axial bore; wherein the rotor rotates within the stator upon a media flow through the power assembly;

a valve assembly operatively connected to the rotor; and an activation assembly operatively connected downstream of the rotor, wherein in a first position the activation assembly provides a bypass flow path around the valve assembly for at least a portion of the media flow, wherein the activation assembly is configured to transition from the first position to a second position in response to a variation in an operating condition of the media flow, wherein in the second position of the activation assembly the bypass flow path is substantially closed;

wherein the valve assembly is configured to generate significant pressure pulses in a media flow column with the rotation of the rotor only when the activation assembly is in the second position.

10. The downhole friction reduction tool of claim 9, wherein the rotor is a single lobe rotor.

11. The downhole friction reduction tool of claim 9, wherein a rotating valve segment of the valve assembly rotates with rotation of the rotor when the activation assembly is in the first position and in the second position.

12. The downhole friction reduction tool of claim 9, wherein the variation in the operating condition of the media flow is an increase in a flow rate of the media flow.

13. The downhole friction reduction tool of claim 9, wherein the variation in the operating condition of the media flow is an increase in a density of a media in the media flow.

14. The downhole friction reduction tool of claim 9, wherein the bypass flow path includes one or more bypass ports that are open in the first position of the activation assembly and closed in the second position of the activation assembly.

15. The downhole friction reduction tool of claim 14, wherein the activation assembly includes a sleeve, wherein the sleeve closes the one or more bypass ports in the second position of the activation assembly.

16. A method of selectively generating a pressure pulse in a downhole string, comprising the steps of:

a) providing one or more selectively activated friction reduction tools each comprising: a power assembly; a valve assembly operatively connected downstream of the power assembly, the valve assembly including a rotating valve segment and a stationary valve segment; and an activation assembly operatively connected downstream of the power assembly, wherein in a first position the activation assembly provides a bypass flow path around the valve assembly for at least a portion of the media flow, wherein the activation assembly is configured to transition from the first position to a second position in response to a variation in an operating condition of the media flow, wherein in the second position of the activation assembly the bypass flow path is substantially closed; wherein the power assembly is configured to rotate the rotating valve segment in relation to the stationary valve segment upon a media flow through the power assembly; wherein the valve assembly is configured to generate significant pressure pulses in a media flow column with the rotation of the rotating valve segment only when the activation assembly is in the second position;

b) securing the one or more friction reduction tools with the activation assembly in the first position between segments of the downhole string; wherein the downhole string includes a drill string or a coiled tubing line;

c) lowering the downhole string with the one or more friction reduction tools into a wellbore;

d) pumping a media through the downhole string and the one or more friction reduction tools; wherein the media causes the power assembly of each friction reduction tool to rotate the rotating valve segment of the valve assembly; wherein at least a portion of the media flows through the bypass flow path around the valve assembly when the activation assembly is in the first position; wherein no significant pressure pulse is generated by the valve assembly with the activation assembly in the first position;

e) selectively activating an activated friction reduction tool selected from the one or more friction reduction tools while positioned within the wellbore by varying the operating condition of the media to transition the activation assembly of the activated friction reduction tool from the first position to the second position in which the bypass flow path is substantially closed; and f) continuing to pump media through the downhole string and the one or more friction reduction tools with the activation assembly of the activated friction reduction tool in the second position; wherein the media continues to cause the power assembly to rotate the rotating valve segment of the valve assembly and substantially all of the media flows through the valve assembly with the activation assembly in the second position in the activated friction reduction tool; wherein the rotation of the rotating valve segment of the valve assembly in the activated friction reduction tool generates significant pressure pulses that are transmitted to the downhole string.

17. The method of claim 16, wherein in step (e) varying the operating condition of the media comprises increasing a flow rate of the media.

18. The method of claim 16, wherein in step (e) varying the operating condition of the media comprises increasing a density of the media.

19. The method of claim 16, wherein in step (f) the generated significant pressure pulses stretch the drill string, a shock sub connected to the drill string, or the coiled tubing line to generate an axial vibration.

20. The method of claim 16, wherein in step (e) the activation assembly of the activated friction reduction tool is transitioned from the first position to the second position by sliding a sleeve of the activation assembly into a position in which the sleeve closes one or more bypass ports of the activation assembly to close or limit the bypass flow path.

21. The method of claim 16, wherein in step (b) the one or more friction reduction tools include a downhole tool and an upstream tool that are both secured within the downhole string with the downstream tool downstream of the upstream tool; wherein in step (e) the upstream tool is selectively activated by the variation of the operating condition of the media without selectively activating the downstream tool; wherein in step (f) the upstream tool generates significant pressure pulses while the downstream tool does not generate significant pressure pulses.

22. The method of claim 21, further comprising the steps of:

g) selectively activating the downstream tool while positioned within the wellbore by a second variation in the operating condition of the media after the upstream tool has been activated; and h) continuing to pump media through the downhole string, the upstream tool, and the downstream tool with the activation assembly of each of the downstream and upstream tools in the second position; wherein the media continues to cause the power assembly to rotate the rotating valve segment of each of the downstream and upstream tools to generate significant pressure pulses with both the downstream and upstream tools.

* * * * *